US012714231B2

(12) United States Patent
Xiang et al.

(10) Patent No.: US 12,714,231 B2
(45) Date of Patent: Aug. 25, 2026

(54) ELECTRIC ADJUSTABLE BED

(71) Applicant: FLEXISPOT, INC., Irvine, CA (US)

(72) Inventors: Lehong Xiang, Ningbo (CN); Haojie Zheng, Ningbo (CN); Guibing Yang, Ningbo (CN); Zhengjun Chen, Ningbo (CN); Pei Li, Ningbo (CN); Cheng Zhang, Ningbo (CN)

(73) Assignee: FLEXISPOT, INC., Irvine, CA (US)

( * ) Notice: Subject to any disclaimer, the term of this patent is extended or adjusted under 35 U.S.C. 154(b) by 57 days.

(21) Appl. No.: 18/888,207

(22) Filed: Sep. 18, 2024

(65) Prior Publication Data

US 2025/0134268 A1 May 1, 2025

(30) Foreign Application Priority Data

Oct. 30, 2023 (CN) ..... 202322940036.5
Aug. 12, 2024 (CN) ..... 202421953503.6

(51) Int. Cl.
*A47C 20/04* (2006.01)

(52) U.S. Cl.
CPC ..... *A47C 20/041* (2013.01)

(58) Field of Classification Search
CPC ..... A47C 19/04; A47C 20/041; A47C 19/045; A47C 19/021; A47C 20/04
USPC ..... 5/618
See application file for complete search history.

(56) References Cited

U.S. PATENT DOCUMENTS

2014/0366267 A1* 12/2014 Suh ..... A47C 20/041 5/174
2021/0219735 A1* 7/2021 Huang ..... A47C 20/042

FOREIGN PATENT DOCUMENTS

CN 108720413 A * 11/2018 ..... A47C 19/02
CN 110897413 A * 3/2020 ..... A47C 17/17
CN 111329282 A * 6/2020 ..... A47C 20/04
CN 115500645 A * 12/2022 ..... A47C 19/22
KR 102112591 B1 * 5/2020 ..... A47C 20/12

OTHER PUBLICATIONS

Translation CN-108720413-A (Year: 2026).*
Translation CN-110897413-A (Year: 2026).*
Translation CN-111329282-A (Year: 2026).*
Translation CN-115500645-A (Year: 2026).*
Translation KR-102112591-B1 (Year: 2026).*

* cited by examiner

*Primary Examiner* — J. T. Newton
(74) *Attorney, Agent, or Firm* — Getech Law LLC; Jun Ye

(57) ABSTRACT

An electric adjustable bed is provided. The electric adjustable bed includes a bed frame body, a cantilever assembly, and a linear actuator, where the bed frame body includes a bed framework and a movable bed frame that is rotatable relative to the bed framework; the cantilever assembly is located below the bed frame body and connected to the bed frame body; the cantilever assembly is provided with a mounting point, and includes a first pull rod and a second pull rod; the first pull rod, the second pull rod, and the bed framework form a triangular support structure; the linear actuator includes an actuator body and a driving end; and the driving end and the actuator body are rotatably connected to the movable bed frame and the mounting point.

15 Claims, 6 Drawing Sheets

ELECTRIC ADJUSTABLE BED

CROSS-REFERENCE TO THE RELATED APPLICATIONS

This application is based upon and claims priorities to Chinese Patent Application No. 202322940036.5, filed on Oct. 30, 2023; and Chinese Patent Application No. 202421953503.6, filed on Aug. 12, 2024, the entire contents of which are incorporated herein by reference.

TECHNICAL FIELD

The present disclosure relates to the technical field of furniture and equipment, and in particular to an electric adjustable bed.

BACKGROUND

With the improvement of people's living standards, electric adjustable beds have become widely used. An electric adjustable bed in the related art includes a bed framework, bed legs, and a backrest support and a leg support connected to the bed framework. The backrest support is also known as a movable bed frame, while the bed framework and the leg support are also known as fixed bed frames. One end of the backrest support is hinged to the leg support. A linear actuator for driving the backrest support to rotate is connected between the backrest support and the bed framework. The electric adjustable bed is deeply loved by users as it can adjust the user's sleeping postures such as lying down and sitting to relieve the user from fatigue.

In the related art, the linear actuator of the electric adjustable bed includes an upper end hinged to the back of the movable bed frame and a lower end hinged to a rotating connection of the bed framework close to the movable bed frame. For example, the prior patent application CN115500645A, filed by the applicant of the present disclosure, proposes a connection method for a linear actuator. In order to reduce the thrust of the linear actuator when the movable bed frame rotates upward from the initial horizontal state, the fixed bed frame is provided with an auxiliary driving mechanism that is linked to the linear actuator. The auxiliary driving mechanism drives the movable bed frame to rotate a certain angle, and then the linear actuator drives the movable bed frame to continuously unfold. In another manner, for the traditional simplest and most economical direct push structure, in order to reduce the thrust of the linear actuator when the movable bed frame rotates upward from the initial horizontal state, the connection point between the linear actuator and the fixed bed frame, that is, the mounting point or support position of the linear actuator, is lowered and set towards the movable bed frame. In this way, when the movable bed frame is in the horizontal state, the tilt angle of the linear actuator increases, causing most of the thrust of the linear actuator to be converted into the thrust for driving the rotation of the movable bed frame, thereby reducing the thrust of the linear actuator.

However, the electric adjustable bed in the related art has the following defects in actual production or use. In the first case, the electric lift adjustable bed uses the auxiliary driving mechanism to reduce the thrust of the linear actuator when the movable bed frame rotates upward from the initial horizontal state. In this case, the auxiliary driving mechanism requires a large number of components, has a complex structure, and is difficult to assemble, resulting in increased production costs and making it difficult to promote in large quantities. In the second case, the electric lift adjustable bed reduces the thrust of the linear actuator when the movable bed frame rotates upward from the initial horizontal state by lowering the mounting point of the linear actuator. In this case, the fixed bed frame is connected to a cantilever that tilts from top to bottom towards the movable bed frame. The free end of the cantilever forms the mounting point of the linear actuator. When the mounting point of the linear actuator is lowered further away from the fixed bed frame, the tilt angle of the linear actuator increases, and the cantilever is lengthened. In this way, the stress on the cantilever increases, which will inevitably lead to an increase in the thickness of the fixed bed frame of the electric bed. The increase in the thickness of the fixed bed frame and the lowering of the mounting point of the cantilever will increase the volume of the electric bed folded and packaged, resulting in a doubling of transportation costs. Furthermore, a longer cantilever will lead to poorer rigidity, resulting in poorer support and stability of the movable bed frame when unfolded.

SUMMARY

To overcome the above-mentioned defects in the related art, a technical problem to be solved by the present disclosure is to provide an electric adjustable bed. The electric adjustable bed features a simple structure, strong support capacity, and good stability. When a movable bed frame is in an initial horizontal state, the linear actuator has a large tilt angle, without causing an increase in a thickness of a fixed bed frame, ensuring a small packaging volume and low transportation costs.

To solve the above-mentioned technical problem, the present disclosure provides an electric adjustable bed. The electric adjustable bed includes:

- a bed frame body, including a bed framework and a movable bed frame that is rotatable relative to the bed framework to adjust an angle;
- a cantilever assembly, located below the bed frame body and connected to the bed frame body, where the cantilever assembly is provided with a mounting point, and includes a first pull rod and a second pull rod; and the first pull rod, the second pull rod, and the bed framework form a triangular support structure; and
- a linear actuator, including an actuator body and a driving end that reciprocates axially relative to the actuator body, where the driving end or the actuator body is rotatably connected to the movable bed frame, and the actuator body or the driving end is rotatably connected to the mounting point, such that when the movable bed frame is driven to rotate relative to the bed framework, a reaction force of a thrust of the linear actuator is distributed to the first pull rod and the second pull rod of the cantilever assembly.

In some embodiments, the bed framework is provided with a first mounting position and a second mounting position in sequence in a length direction; the first mounting position is provided with a fixed bed frame; and the second mounting position is provided with the movable bed frame.

In some embodiments, at least a portion of the cantilever assembly is located below the fixed bed frame; the first pull rod includes a first end connected to the fixed bed frame and a second end positioned from top to bottom towards the movable bed frame; the second pull rod includes a first end connected to the fixed bed frame and a second end connected to the second end of the first pull rod; the first pull rod, the second pull rod, and the fixed bed frame form the triangular support structure; and a connection point between the second pull rod and the first pull rod forms the mounting point.

In some embodiments, the first end of the first pull rod is rotatably connected to the fixed bed frame, the second end of the first pull rod is rotatably connected to the second end of the second pull rod, and the first end of the second pull rod is detachably connected to the fixed bed frame.

In some embodiments, after the first end of the second pull rod is detached from the fixed bed frame, the second pull rod is rotatable until the second pull rod is fitted or partially fitted onto the first pull rod.

In some embodiments, the fixed bed frame is connected to a hanging frame; the hanging frame is provided with a hook; the first end of the second pull rod is connected to a hanging post; and the hanging post is hung to the hook.

In some embodiments, the second end of the second pull rod or the second end of the first pull rod is connected to a support arm extending towards a lower side of the movable bed frame; and the mounting point is located on a rotating shaft of the support arm.

In some embodiments, the fixed bed frame is connected to a first support tube extending in a length direction of the fixed bed frame; the fixed bed frame is further connected to a second support tube extending in a width direction of the fixed bed frame; the second support tube is fixedly connected to an end of the first support tube close to the movable bed frame; the first end of the first pull rod is rotatably connected to the first support tube, and the first end of the second pull rod is connected to the second support tube; the movable bed frame is connected to a third support tube extending in a length direction of the movable bed frame; the third support tube and the first support tube are located at a center of the bed frame body; the driving end of the linear actuator is rotatably connected to the third support tube; and the first support tube, the third support tube, the first pull rod, the second pull rod, and the actuator body are located on a same vertical plane.

In some embodiments, an end of the movable bed frame away from the fixed bed frame is slidably connected to a head bracket in a length direction of the movable bed frame.

In some embodiments, two side walls of the movable bed frame are provided with two sliding grooves that extend in the length direction of the movable bed frame; two connecting ends of the head bracket are slidably fitted into the two sliding grooves, respectively; and the movable bed frame is connected to connecting screws for fixing the connecting ends of the head bracket into the sliding grooves.

In some embodiments, at least one side of the movable bed frame is connected to a side guard frame; the side guard frame includes a mounting frame connected to the movable bed frame and a U-shaped guard frame connected to the mounting frame; the U-shaped guard frame is provided with multiple adjustment holes distributed in a height direction; and the adjustment holes are connected to the mounting frame through fasteners.

In some embodiments, the cantilever assembly is located below the movable bed frame; a first end of the first pull rod is connected to the bed framework; a first end of the second pull rod is connected to the bed framework or the fixed bed frame; a second end of the first pull rod is connected to a second end of the second pull rod; and the mounting point is formed at the second end of the second pull rod.

In some embodiments, a length dimension of the second pull rod is smaller than a length dimension of the first pull rod.

In some embodiments, compared to a connection point between the second end of the second pull rod and the second end of the first pull rod, the mounting point is located closer to the bed framework.

In some embodiments, a distance from the mounting point to the bed framework is greater than a distance from the mounting point to a ground.

In some embodiments, an end of the bed framework close to a headboard bracket is connected to a rail provided in a width direction of the bed framework; the rail and the end of the bed framework close to the headboard bracket are connected to a connecting rod; and the connecting rod and the cantilever assembly are located on a same plane.

Overall, compared with the related art, the electric adjustable bed in present disclosure has the following advantages.

Firstly, in the electric adjustable bed, the lower side of the bed frame body is connected to the cantilever assembly, and the cantilever assembly is provided with the mounting point. The cantilever assembly includes the first pull rod and the second pull rod, and the bed framework, the first pull rod, and the second pull rod form a triangular support structure. The two ends of the linear actuator are respectively connected to the movable bed frame and the mounting point. Therefore, the cantilever assembly can lower the mounting point of the linear actuator. In this way, when the movable bed frame is in the initial horizontal state, a tilt angle between the linear actuator and the movable bed frame increases, and an axial thrust of the linear actuator is more converted into rotational power of the movable bed frame. On the contrary, the thrust of the linear actuator can be set smaller. That is to say, when the movable bed frame rotates upward from the initial horizontal state, the thrust of the linear actuator can be smaller.

Secondly, when the linear actuator drives the movable bed frame to rotate relative to the fixed bed frame, the reaction force of the axial thrust of the linear actuator is dispersed on the first pull rod and the second pull rod of the cantilever assembly. In other words, the reaction force of the axial thrust of the linear actuator is jointly borne by the first pull rod and the second pull rod. In this way, the force exerted by the first pull rod and the second pull rod on the fixed bed frame or the bed framework is greatly reduced, avoiding deformation of the fixed bed frame or the bed framework. Therefore, there is no need to increase the thickness of the fixed bed frame or the bed framework, which reduces the folded or packaging volume of the electric adjustable bed and lowers transportation costs.

Thirdly, the first pull rod and the second pull rod of the cantilever assembly form a triangular support structure with the bed framework, which has strong support capacity and stable structure, providing the movable bed frame with strong support capacity and good stability in the raised or unfolded state. The design further improves the support capacity and stability of the linear actuator, reduces the height of the mounting point, further increases the tilt angle of the linear actuator, and thereby further reduces the thrust of the linear actuator. Meanwhile, the design increases the overall rigidity of the bed framework and reduces the deformation risk of the bed framework caused by the expansion and retraction of the linear actuator.

REFERENCE NUMERALS

Figure 1:
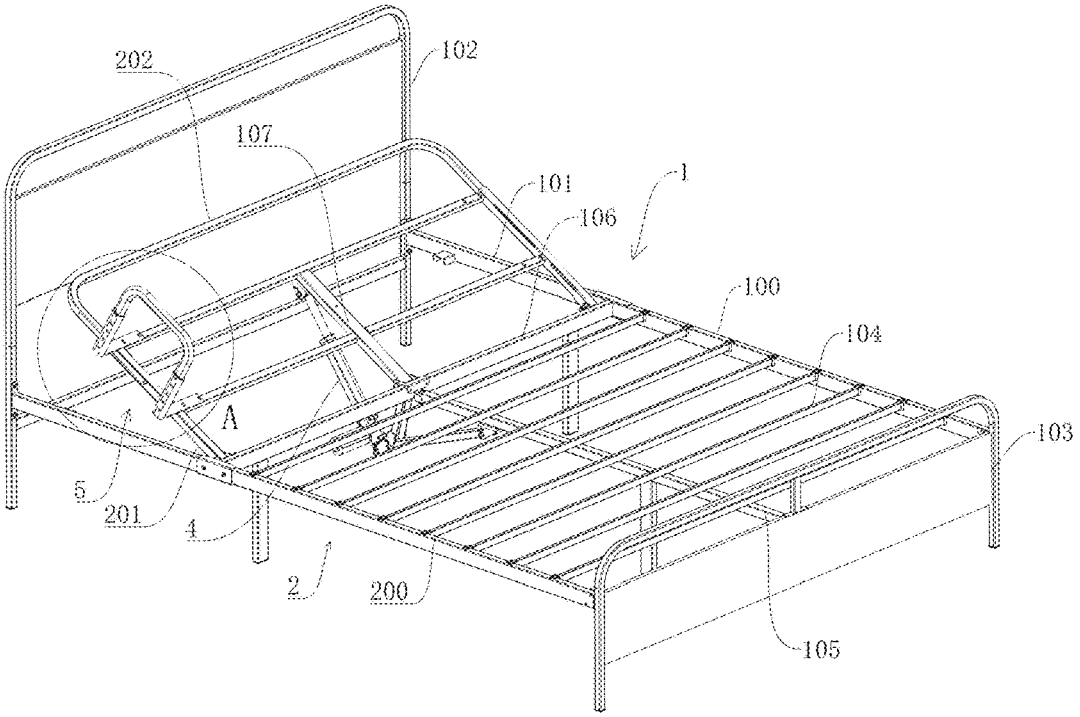
FIG. 1 is a structural diagram of an electric adjustable bed according to some embodiments of the present disclosure.

1. bed framework; 100. first mounting position; 101. second mounting position; 102. headboard bracket; 103. footboard bracket; 104. crossbar; 105. first support tube; 106. second support tube; 107. third support tube; 108. connecting rod; 109. rail; 110. sliding groove; 2. bed frame body; 200. fixed bed frame; 201. movable bed frame; 202. head bracket; 203. connecting end; 3. cantilever assembly; 300. first pull rod; 301. second pull rod; 302. mounting point; 303. connection point; 304. hanging post; 305. support arm; 306. rotating shaft; 307. base; 4. linear actuator; 400. actuator body; 401. driving end; 402. driving motor; 5. side guard frame; 500. mounting frame; 501. U-shaped guard frame; 502. adjustment hole; 6. hanging frame; and 600. hook.

DETAILED DESCRIPTION OF THE EMBODIMENTS

Firstly, those skilled in the art should understand that the implementations herein are merely intended to explain the technical principles of the embodiments in the present disclosure, rather than to limit the protection scope of the embodiments in the present disclosure. Those skilled in the art can make adjustments to the implementations as needed in order to adapt to specific application scenarios.

In the description of the embodiments in the present disclosure, it should be noted that, unless otherwise clearly specified and limited, meanings of terms "connected with" and "connected to" should be understood in a broad sense. For example, the connection may be a fixed connection, a removable connection, an integral connection, a mechanical connection, an electrical connection, a direct connection or an indirect connection through a medium. Those of ordinary skill in the art may understand specific meanings of the foregoing terms in the embodiments of the present disclosure based on a specific situation.

In the embodiments of the present disclosure, unless otherwise explicitly specified and limited, when it is described that a first feature is "above" or "below" a second feature, it indicates that the first and second features are in direct contact or the first and second features are in indirect contact through an intermediate feature. In addition, when it is described that the first feature is "over", "above" and "on" the second feature, it indicates that the first feature is directly or obliquely above the second feature, or simply indicates that an altitude of the first feature is higher than that of the second feature. When it is described that the first feature is "under", "below" or "beneath" the second feature, it indicates that the first feature is directly or obliquely under the second feature or simply indicates that an altitude of the first feature is lower than that of the second feature.

The present disclosure will be further described in detail below in conjunction with the drawings and specific embodiments.

In the following embodiments of the present disclosure, FIGS. 1, 2, 3, 4, 5, 6, and 7 show an electric adjustable bed in a first embodiment of the present disclosure, and FIGS. 8, 9, 10, and 11 show an electric adjustable bed in a second embodiment of the present disclosure.

First Embodiment

Referring to FIGS. 1 to 7, this embodiment of the present disclosure provides an electric lift adjustable bed, including bed frame body 2, cantilever assembly 3, and linear actuator 4. The bed frame body 2 includes bed framework 1, fixed bed frame 200, and movable bed frame 201. Two ends of the bed framework 1 are respectively connected to headboard bracket 102 and footboard bracket 103. The bed framework 1 is provided with first mounting position 100 and second mounting position 101 arranged in sequence from a tail to a head in a length direction. The fixed bed frame 200 is connected to the first mounting position 100. The movable bed frame 201 is located at the second mounting position 101. The movable bed frame 201 is rotatably connected to the fixed bed frame 200 or the bed framework 1, allowing the movable bed frame 201 to rotate relative to the fixed bed frame 200 to adjust an angle. The movable bed frame 201 and the fixed bed frame 200 each are formed with multiple metal crossbars 104 connected together. A bottom of the bed framework 1 is connected to bed legs. When the movable bed frame 201 is in an initial or horizontal state, the movable bed frame 201 and the fixed bed frame 200 are aligned and on a same horizontal plane. The linear actuator 4 is configured to provide power for the rotation of the movable bed frame 201, and the movable bed frame 201 is rotatable relative to the fixed bed frame 200 under the drive of the linear actuator 4 to adjust the angle.

Figure 2:
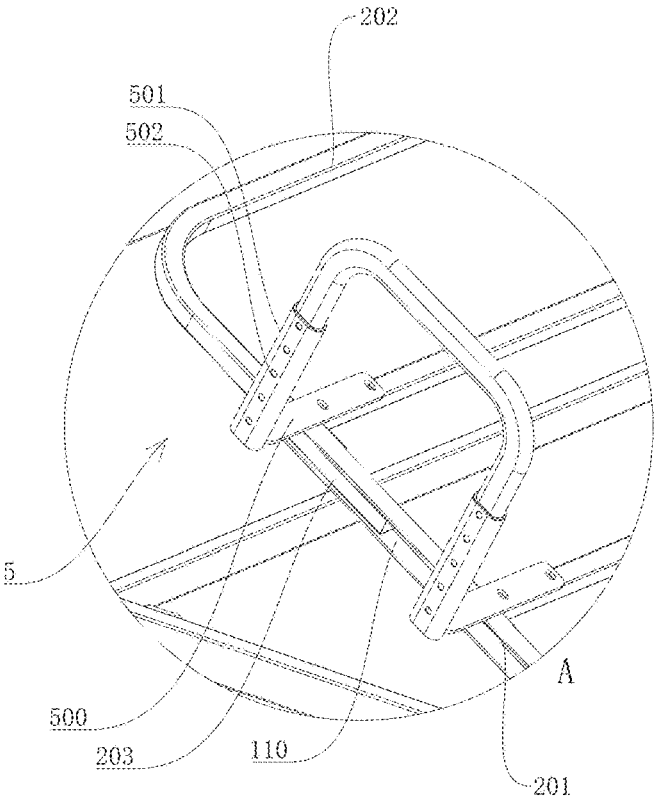
FIG. 2 is an enlarged view of A shown in FIG. 1.

Furthermore, in this embodiment, as shown in FIGS. 1 and 2, the fixed bed frame 200 is fixedly connected to the bed framework 1. The movable bed frame 201 is located at one end of the fixed bed frame 200 close to the headboard bracket 102, and the movable bed frame 201 is rotatably connected to the end of the fixed bed frame 200 through a hinge pin. An end of the movable bed frame 201 away from the fixed bed frame 200 is slidably connected to U-shaped head bracket 202 in a length direction of the movable bed frame 201. The head bracket 202 is provided with two parallel connecting ends 203. Specifically, two side walls of the movable bed frame 201 are provided with two sliding grooves 110 that extend in the length direction of the movable bed frame 201. The two connecting ends 203 of the head bracket 202 are slidably fitted into the two sliding grooves 110, respectively, allowing an adjustable position of the head bracket 202 relative to the movable bed frame 201. The movable bed frame 201 is connected to connecting screws for fixing the connecting ends 203 of the head bracket 202 into the sliding grooves 110. The connecting screws are configured to fix the head bracket 202 after a position adjustment of the head bracket 202. The design reduces the packaging volume of the movable bed frame 201 and lowers transportation costs.

Furthermore, as shown in FIG. 2, at least one side of the movable bed frame 201 is connected to side guard frame 5. The side guard frame 5 serves as an armrest to assist the user on the bed in getting up and out of the bed. Specifically, the side guard frame 5 includes mounting frame 500 connected to the movable bed frame 201 and U-shaped guard frame 501 connected to the mounting frame 500. The U-shaped guard frame 501 is provided with multiple adjustment holes 502 distributed in a height direction. The adjustment holes 502 are connected to the mounting frame 500 through fasteners. In this way, the side guard frame 5 can be used to adjust the height of the U-shaped guard frame 501 according to user needs.

In this embodiment, the cantilever assembly 3 is located below the fixed bed frame 200. The cantilever assembly 3 is configured to provide support for the linear actuator 4. One end of the linear actuator 4 is rotatably connected to the movable bed frame 201, and the other end of the linear actuator 4 is rotatably connected to mounting point 302 on the cantilever assembly 3. Specifically, as shown in FIGS. 3, 4, 5, 6, and 7, at least a portion of the cantilever assembly 3 is located below the fixed bed frame 200. The cantilever assembly 3 includes first pull rod 300 and second pull rod 301. The first pull rod 300 is an elongated rod with a first end and a second end opposite to the first end. The second pull rod 301 is an elongated rod with a first end and a second end opposite to the first end. The first end of the first pull rod 300 is connected to the fixed bed frame 200, and the second end of the first pull rod 300 is positioned from top to bottom towards the movable bed frame 201. The first end of the second pull rod 301 is connected to the fixed bed frame 200, and the second end of the second pull rod 301 is connected to the second end of the first pull rod 300. Therefore, the fixed bed frame 200, the first pull rod 300, and the second pull rod 301 form a triangular support structure, and a connection point between the second end of the second pull rod 301 and the second end of the first pull rod 300 forms the mounting point 302. The mounting point 302 is located below the fixed bed frame 200 and extends towards the movable bed frame 201. Two ends of the linear actuator 4 are connected to the movable bed frame 201 and the mounting point 302, respectively.

It is not difficult to understand that the triangular support structure of the cantilever assembly 3 enhances the support stability of the mounting point 302 of the linear actuator 4, allowing the mounting point 302 to be lowered to the maximum extent towards a lower side of the movable bed frame 201. In this way, when the movable bed frame 201 is in the initial horizontal state, a tilt angle between the linear actuator 4 and the movable bed frame 201 increases, and an axial thrust of the linear actuator 4 is more converted into rotational power of the movable bed frame 201. On the contrary, the thrust of the linear actuator 4 can be set smaller to ensure the power of the movable bed frame 201 rotating upward from the initial horizontal state. That is to say, when the movable bed frame 201 rotates upward from the initial horizontal state, the thrust of the linear actuator 4 can be smaller. Therefore, the first pull rod 300 and the second pull rod 301 of the cantilever assembly 3 form a triangular support structure with the fixed bed frame 200. The design further improves the support capacity and stability of the linear actuator 4, and reduces the height of the mounting point 302, further increasing the tilt angle of the linear actuator 4 and thereby further reducing the thrust of the linear actuator 4.

In this embodiment, the linear actuator 4, also known as a linear motor or an electric push rod, includes driving motor 402, actuator body 400, and driving end 401 that reciprocates axially relative to the actuator body 400. The driving motor 402 is connected in a transmission manner to the actuator body 400 for driving the driving end 401 to reciprocate axially.

Furthermore, in this embodiment, the driving end 401 of the linear actuator 4 is rotatably connected to the movable bed frame 201, and a tail end of the actuator body 400 is rotatably connected to the mounting point 302. When the linear actuator 4 drives the movable bed frame 201 to rotate relative to the fixed bed frame 200, a reaction force of the thrust of the linear actuator 4 is converted into a pressure of the first pull rod 300 and a tension of the second pull rod 301. The reaction force of the axial thrust of the linear actuator 4 is jointly borne by the first pull rod 300 and the second pull rod 301. In this way, the force exerted by the first pull rod 300 and the second pull rod 301 on the fixed bed frame 200 is greatly reduced, avoiding deformation of the fixed bed frame 200. Therefore, there is no need to increase the thickness of the fixed bed frame 200, which reduces the folded and packaging volume of the electric lift adjustable bed and lowers transportation costs.

It can be understood that if the mounting point 302 of the cantilever assembly 3 is set lower, the distance from the mounting point 302 of the cantilever assembly 3 to the fixed bed frame 200 increases, leading to an increase in the tilt angle of the linear actuator 4 and thereby reducing the thrust of the linear actuator 4 in the initial state. However, when the bed frame body 2 is folded and packaged, the cantilever assembly 3 will occupy more packaging space, resulting in increased transportation costs. Therefore, in the embodiments of the present disclosure, in order to solve the above-mentioned problem, as shown in FIGS. 4, 5, 6, and 7, the first end of the first pull rod 300 is rotatably connected to the fixed bed frame 200, the second end of the first pull rod 300 is rotatably connected to the second end of the second pull rod 301, and the first end of the second pull rod 301 is detachably connected to the fixed bed frame 200. Therefore, when the linear actuator 4 is used to drive the movable bed frame 201 to rotate, the first end of the second pull rod 301 is connected to the fixed bed frame 200, and the cantilever assembly 3 forms a stable triangular support structure. When the linear actuator 4 is not used to drive the movable bed frame 201 to rotate, such as when the electric lift adjustable bed is packaged at the factory, the first end of the second pull rod 301 is disconnected from the fixed bed frame 200, and the first pull rod 300 is in the horizontal position. The mounting point 302 of the cantilever assembly 3 moves upward, thereby reducing the thickness of the fixed bed frame 200 and reducing the packaging volume.

Figure 6:
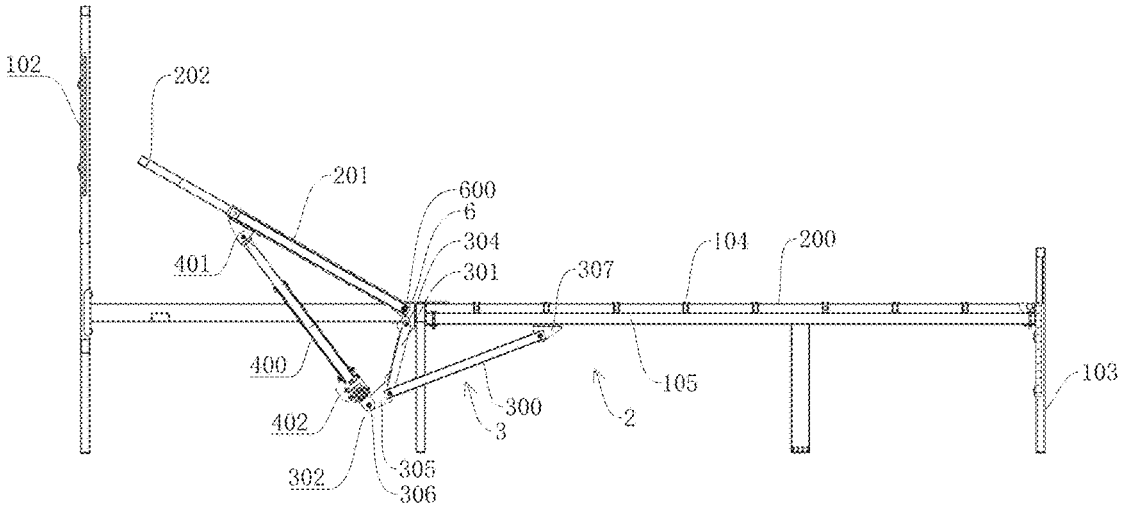
FIG. 6 is a section view of the electric adjustable bed according to some embodiments of the present disclosure.

For example, as shown in FIG. 6, the first end of the second pull rod 301 is detachably connected to the fixed bed frame 200. That is, the fixed bed frame 200 is connected to hanging frame 6, and the hanging frame 6 is provided with hook 600. The first end of the second pull rod 301 is connected to hanging post 304, and the hanging post 304 is hung to the hook 600. When the hanging post 304 on the first end of the second pull rod 301 is hung to the hook 600 of the hanging frame 6, the first pull rod 300 and the second pull rod 301 form a triangular support structure with the fixed bed frame 200. When the hanging post 304 is removed from the hook 600, the mounting point 302 of the cantilever assembly 3 can move upward.

In other embodiments, the first end of the second pull rod 301 can also be detachably connected to the fixed bed frame 200 through other means. For example, a bolt is provided at the first end of the second pull rod 301, a mounting hole is provided on the fixed bed frame 200, and the bolt is fitted into the mounting hole through a nut.

Furthermore, after the first end of the second pull rod 301 is detached from the fixed bed frame 200, the second pull rod 301 can rotate until it is fitted or partially fitted onto the first pull rod 300. In this way, after the first end of the second pull rod 301 is disconnected, the second pull rod 301 can rotate until it is fitted onto the first pull rod 300. The first pull rod 300 can rotate to a horizontal state, further reducing the volume of the cantilever assembly 3 and the packaging volume of the fixed bed frame 200.

Figure 7:
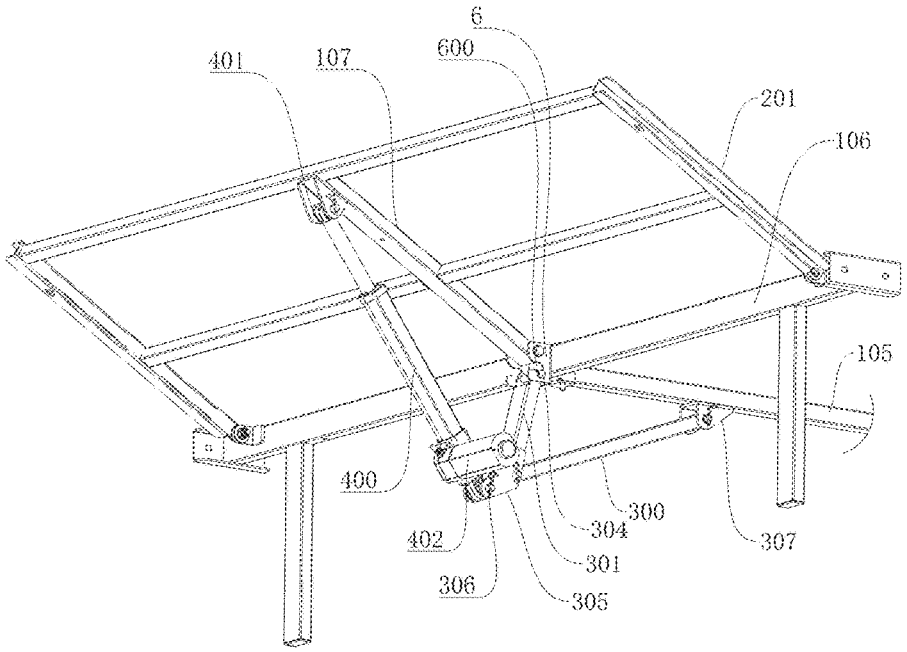
FIG. 7 is a structural diagram of a cantilever assembly of the electric adjustable bed according to some embodiments of the present disclosure.
Figure 8:
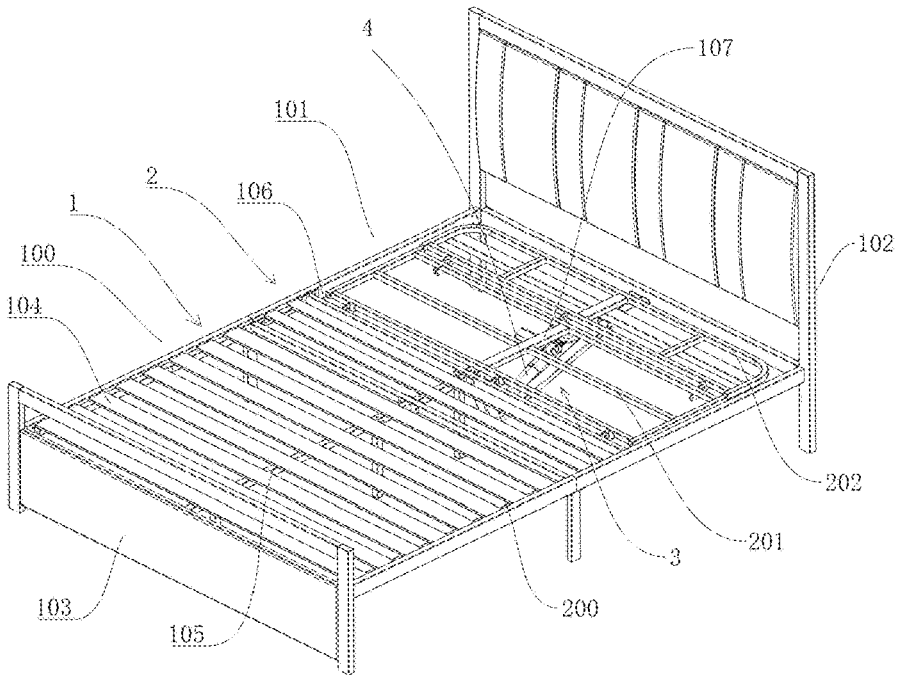
FIG. 8 is a structural diagram of an electric adjustable bed according to some other embodiments of the present disclosure.

Furthermore, the connection point between the second end of the second pull rod 301 and the second end of the first pull rod 300 forms the mounting point 302. Specifically, as shown in FIGS. 6 and 7, the second end of the second pull rod 301 or the second end of the first pull rod 300 is connected to support arm 305 extending towards the lower side of the movable bed frame 201, and the mounting point 302 is located on rotating shaft 306 of the support arm 305. In this embodiment, the support arm 305 is connected to the second end of the second pull rod 301 and extends towards the lower side of the movable bed frame 201 in an axial direction of the second pull rod 301. In other embodiments, the support arm 305 can also be connected to the second end of the first pull rod 300 and extend towards the lower side of the movable bed frame 201 in the axial direction of the first pull rod 300.

Figure 3:
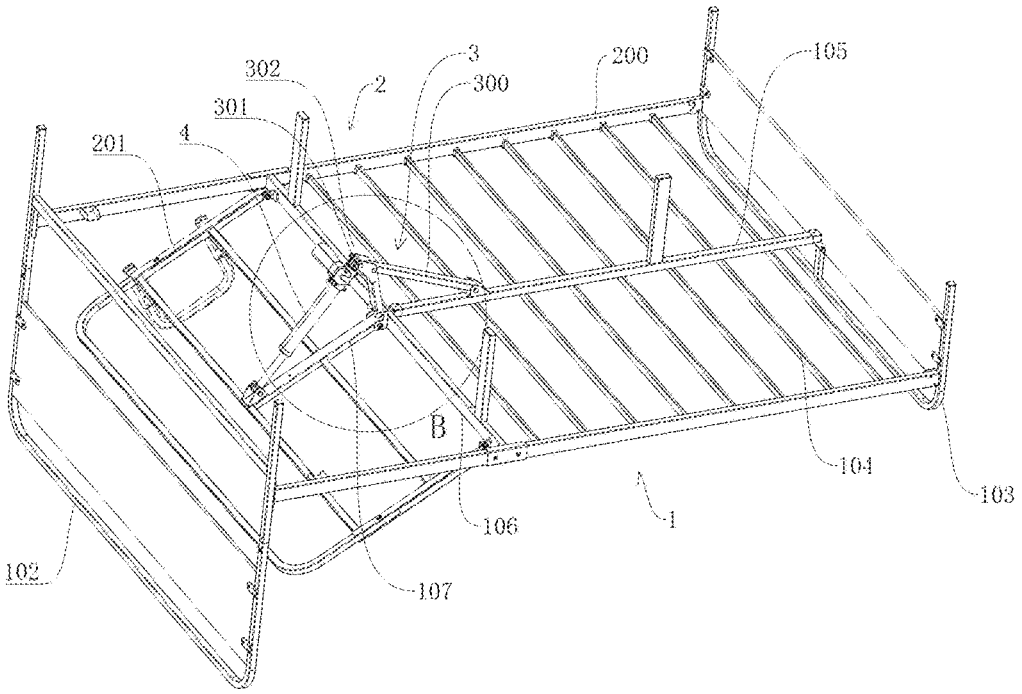
FIG. 3 is a structural diagram of a bottom of the electric adjustable bed according to some embodiments of the present disclosure.
Figure 4:
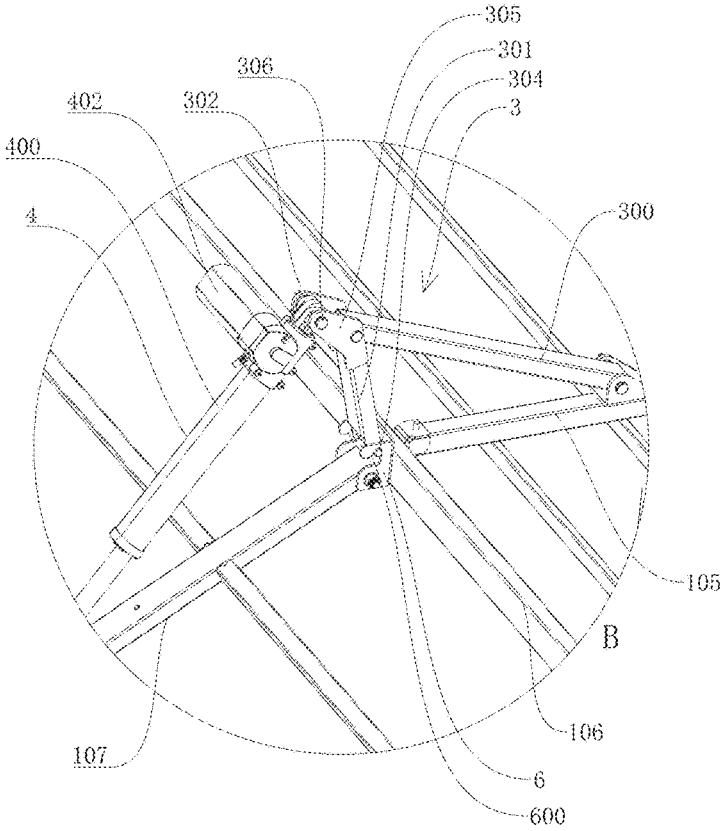
FIG. 4 is an enlarged view of B shown in FIG. 3.
Figure 5:
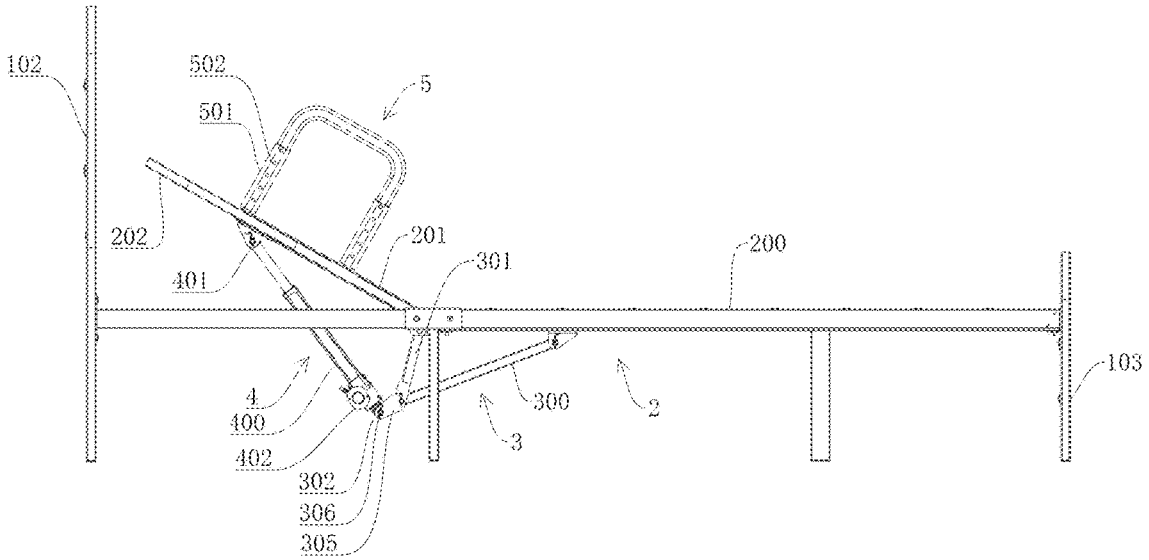
FIG. 5 is a structural diagram of a side of the electric adjustable bed according to some embodiments of the present disclosure.

In some embodiments, in order to make the mounting of the cantilever assembly 3 more stable and avoid deformation of the fixed bed frame 200 caused when the cantilever assembly 3 is subjected to the reaction force of the linear actuator 4, as shown in FIGS. 3 and 7, the fixed bed frame 200 is connected to first support tube 105 extending in a length direction of the fixed bed frame 200. The fixed bed frame 200 is further connected to second support tube 106 extending in a width direction of the fixed bed frame 200. The second support tube 106 is fixedly connected to an end of the first support tube 105 close to the movable bed frame 201. The first end of the first pull rod 300 is rotatably connected to base 307 on the first support tube 105, and the first end of the second pull rod 301 is connected to the second support tube 106. In this embodiment, the movable bed frame 201 is connected to third support tube 107 extending in the length direction of the movable bed frame 201. The third support tube 107 and the first support tube 105 are located at a center of the bed frame body 2. The driving end 401 of the linear actuator 4 is rotatably connected to the third support tube 107. The first support tube 105, the third support tube 107, the first pull rod 300, the second pull rod 301, and the actuator body 400 are located on a same vertical plane. The second end of the second pull rod 301 is detachably connected to the hanging frame 6 on the second support tube 106. Therefore, through the first support tube 105, the second support tube 106, and the third support tube 107, the mounting of the cantilever assembly 3 is more stable, the bed frame body 2 is less likely to deform, and the structure of the bed frame body 2 is more firm and stable.

Second Embodiment

As shown in FIGS. 8 to 11, in this embodiment, the electric adjustable bed further includes cantilever assembly 3. The cantilever assembly 3 is located below the movable bed frame 201 and connected to the bed framework 1. The cantilever assembly 3 extends downward to a lower side of the bed framework 1 and forms mounting point 302 located below the bed framework 1 and always remaining fixed relative to the bed framework 1. The mounting point 302 is located at a side of the rotating connection point 303 close to the movable bed frame 201. The upper end of the linear actuator 4 is hinged to the movable bed frame 201, and a lower end of the linear actuator 4 is hinged to the mounting point 302. That is, the actuator body 400 of the linear actuator 4 is rotatably connected to the movable bed frame 201, and the driving end 401 is rotatably connected to the mounting point 302. Alternatively, the driving end 401 of the linear actuator 4 is rotatably connected to the movable bed frame 201, and the actuator body 400 is rotatably connected to the mounting point 302. In this embodiment, the cantilever assembly 3 forms the mounting point 302 at the lower side of the bed framework 1, and the mounting point 302 remains fixed relative to the bed framework 1. That is, during the unfolding or folding process of the movable bed frame 201, the mounting point 302 can provide stable support.

Compared to the solution of connecting the lower end of the linear actuator 4 to the bed framework 1 or the bed frame body 2, the present disclosure increases the angle between the linear actuator 4 and the movable bed frame 201, thereby improving the support capacity and stability of movable bed frame 201 in the raised or unfolded state. Furthermore, the mounting point 302 at the lower end of the linear actuator 4 remains fixed relative to the bed framework 1, thereby further improving the support capacity and stability of the linear actuator 4.

Furthermore, in the electric adjustable bed, the lower side of the bed frame body 2 is connected to the cantilever assembly 3, and the cantilever assembly 3 is provided with the mounting point 302. The cantilever assembly 3 includes the first pull rod 300 and the second pull rod 301, and the bed framework 1, the first pull rod 300, and the second pull rod 301 form a triangular support structure. The two ends of the linear actuator 4 are respectively connected to the movable bed frame 201 and the mounting point 302. Therefore, the cantilever assembly 3 can lower the mounting point 302 of the linear actuator 4. In this way, when the movable bed frame 201 is in the initial horizontal state, a tilt angle between the linear actuator 4 and the movable bed frame 201 increases, and an axial thrust of the linear actuator 4 is more converted into rotational power of the movable bed frame 201. On the contrary, the thrust of the linear actuator 4 can be set smaller. That is to say, when the movable bed frame 201 rotates upward from the initial horizontal state, the thrust of the linear actuator 4 can be smaller.

When the linear actuator 4 drives the movable bed frame 201 to rotate relative to the fixed bed frame 200, the reaction force of the axial thrust of the linear actuator 4 is dispersed on the first pull rod 300 and the second pull rod 301 of the cantilever assembly 3. In other words, the reaction force of the axial thrust of the linear actuator 4 is jointly borne by the first pull rod 300 and the second pull rod 301. In this way, the force exerted by the first pull rod 300 and the second pull rod 301 on the fixed bed frame 200 or the bed framework 1 is greatly reduced, avoiding deformation of the fixed bed frame 200 or the bed framework 1. Therefore, there is no need to increase the thickness of the fixed bed frame 200 or the bed framework 1, which reduces the folded or packaging volume of the electric adjustable bed and lowers transportation costs.

It can be understood that the first pull rod 300 and the second pull rod 301 of the cantilever assembly 3 form a triangular support structure with the bed framework 1, which has strong support capacity and stable structure, providing the movable bed frame 201 with strong support capacity and good stability in the raised or unfolded state. The design further improves the support capacity and stability of the linear actuator 4, reduces the height of the mounting point 302, further increases the tilt angle of the linear actuator 4, and thereby further reduces the thrust of the linear actuator 4. Meanwhile, the design increases the overall rigidity of the bed framework 1 and reduces the deformation risk of the bed framework 1 caused by the expansion and retraction of the linear actuator 4.

It is not difficult to understand that the mounting point 302 is located at a side close to the rotating connection point 303 of the movable bed frame 201, and the mounting point 302 is not located at a side close to the headboard. When the movable bed frame 201 is in the raised state, the space below or behind the movable bed frame 201 is not occupied, making it easy to clean.

In this embodiment, the horizontal distance from the mounting point 302 to the rotation axis of the movable bed frame 201 is much greater than the horizontal distance from the lower end connection point 303 of the linear actuator 4 to the rotation axis of the movable bed frame 201 in the related art. The horizontal distance refers to the distance between the mounting point 302 in the length direction of the bed framework 1 and the rotation axis of the movable bed frame 201. In other words, compared to the rotation axis of the movable bed frame 201, the mounting point 302 is closer to the headboard bracket 102.

Figure 9:
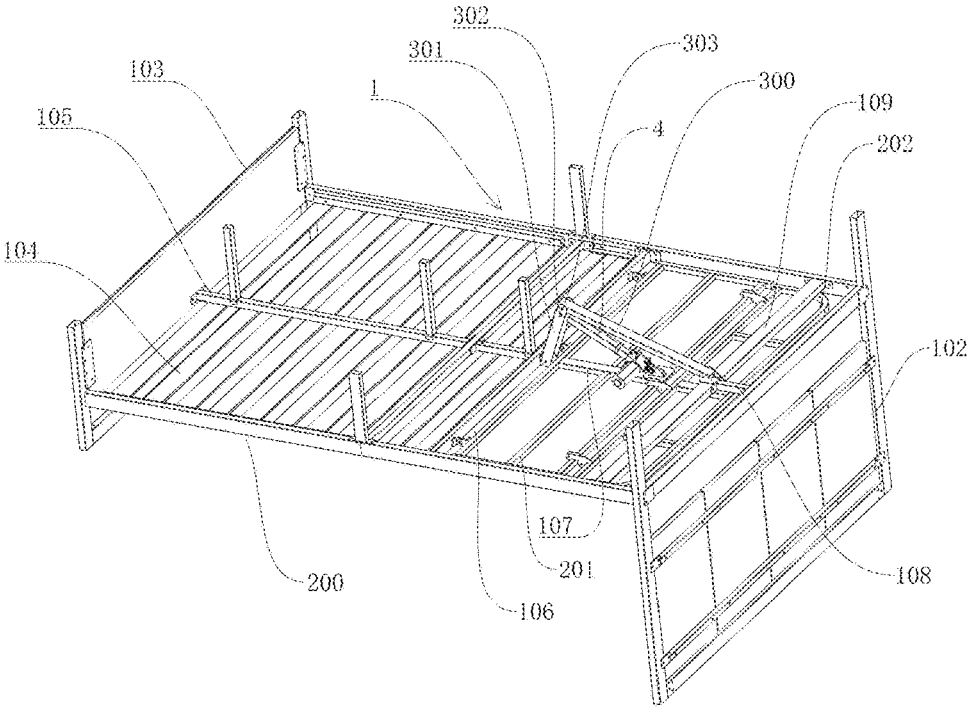
FIG. 9 is a structural diagram of the electric adjustable bed from another perspective according to some other embodiments of the present disclosure.
Figure 10:
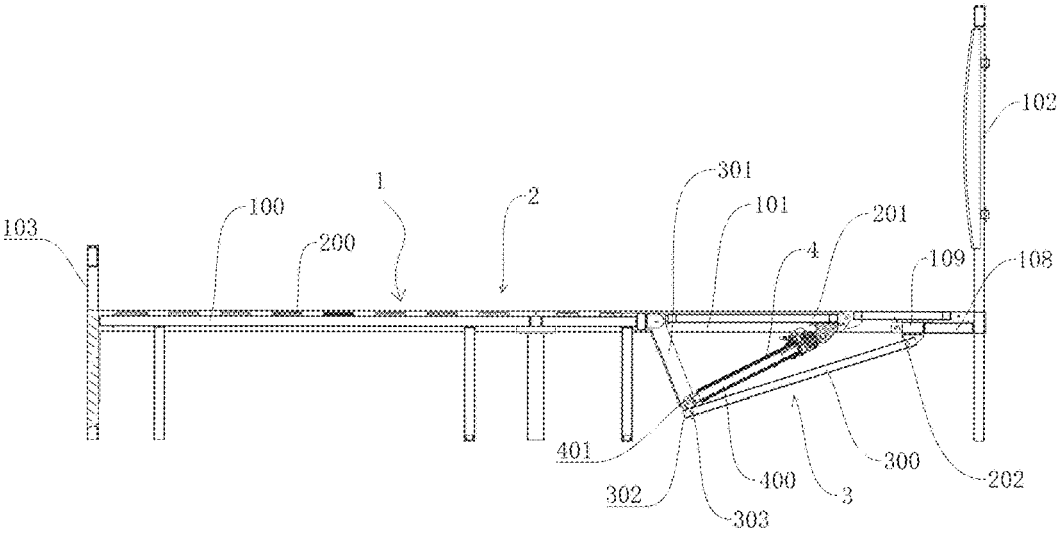
FIG. 10 is a section view of the electric adjustable bed according to some other embodiments of the present disclosure.

In some embodiments, as shown in FIGS. 9 and 10, the cantilever assembly 3 is positioned below the movable bed frame 201. The first end of the first pull rod 300 is connected to the bed framework 1. The first end of the second pull rod 301 is connected to the bed framework 1 or the fixed bed frame 200, and the second end of the first pull rod 300 is connected to the second end of the second pull rod 301. The mounting point 302 is formed at the second end of the second pull rod 301. In this embodiment, the two ends of the first pull rod 300 and the two ends of the second pull rod 301 are connected by pin shafts. Due to the triangular support structure formed by the first pull rod 300, the second pull rod 301, and the bed framework 1, the cantilever assembly 3 has strong support capacity and good stability. Furthermore, the mounting point 302 is located below the bed framework 1. Specifically, the distance from the mounting point 302 to bed framework 1 is greater than the distance from the mounting point 302 to the ground. In this way, the lower end of the linear actuator 4 moves downward in the height direction of the bed, and the linear actuator 4 is not limited by the position between the movable bed frame 201 and the bed framework 1. In this way, the movable bed frame 201 can be in a horizontal state and aligned horizontally with the fixed bed frame 200, and can provide sufficient lift for the movable bed frame 201 to rise from the horizontal state.

Figure 11:
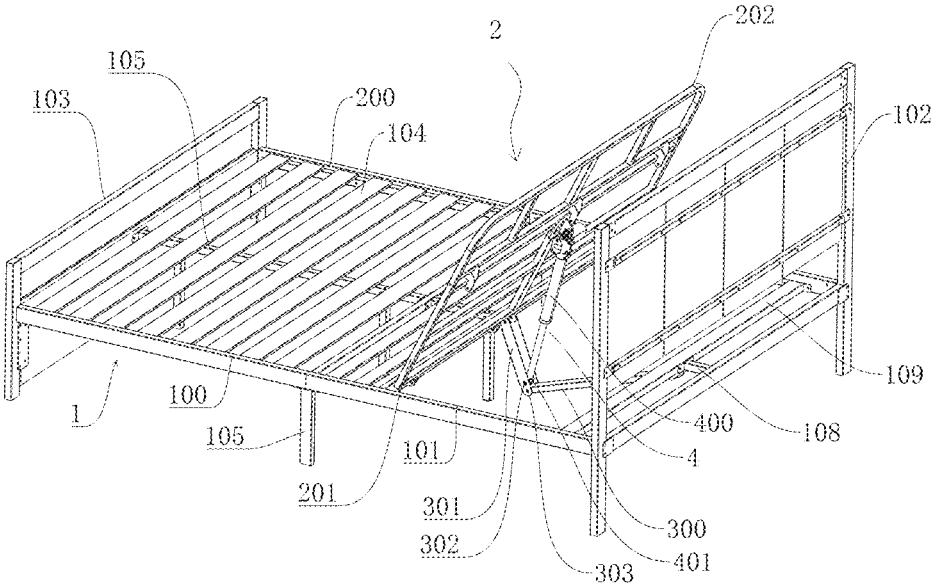
FIG. 11 is a structural diagram of a backrest support, in a raised state, of the electric adjustable bed according to some other embodiments of the present disclosure.

Furthermore, in this embodiment, as shown in FIGS. 10 and 11, the length dimension of the second pull rod 301 is smaller than that of the first pull rod 300. Compared to the connection point 303 between the second end of the second pull rod 301 and the second end of the first pull rod 300, the mounting point 302 is located closer to the bed framework 1. In this way, when the movable bed frame 201 is in a horizontal state, the angle between the linear actuator 4 and the first pull rod 300 is smaller. When the movable bed frame 201 is driven by the linear actuator 4 to rotate upward from the horizontal state, the first pull rod 300 can provide stable support force. Similarly, when the movable bed frame 201 rotates to a high position, the angle between the linear actuator 4 and the second pull rod 301 is smaller, so the second pull rod 301 can provide stable support force.

In some embodiments, an end of the bed framework 1 close to the headboard bracket 102 is connected to rail 109 provided in a width direction of the bed framework 1. The rail 109 and an end of the bed framework 1 close to the headboard bracket 102 are connected to connecting rod 108. The connecting rod 108 and the cantilever assembly 3 are located on a same plane. The connecting rod 108 improves the connection firmness of the second pull rod 301. In this embodiment, the connecting rod 108 and the cantilever assembly 3 are on the same plane. That is, the connecting rod 108 and the cantilever assembly 3 are located at a center position of the bed framework 1, and their projections in a horizontal plane are in a same vertical plane.

It should be noted that in the description of the embodiments in the present disclosure, terms such as "inner" and "outer" indicate orientation or position relationships based on the drawings. They are merely intended to facilitate description, rather than to indicate or imply that the mentioned device or assemblies must have a specific orientation and must be constructed and operated in a specific orientation. Therefore, these terms should not be construed as a limitation to the present disclosure.

In the description of the present disclosure, the description with reference to the terms "one embodiment", "some embodiments", "in this embodiment", "specific examples", or "some examples" means that specific features, mechanisms, materials, or characteristics described in combination with the embodiments or examples are included in at least one embodiment or example of the present disclosure. In this specification, the schematic expression of the above terms is not necessarily directed to the same embodiment or example. Moreover, the specific features, mechanisms, materials, or characteristics described may be combined in a suitable manner in any one or more embodiments or examples. In addition, those skilled in the art may combine different embodiments or examples described in this specification and characteristics of the different embodiments or examples without any contradiction.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of the present disclosure shall be subject to the protection scope of the claims.

What is claimed is:

1. An electric adjustable bed, comprising: a bed frame body, comprising a bed framework and a movable bed frame, wherein the movable bed frame is rotatable relative to the bed framework to adjust an angle; a cantilever assembly, located below the bed frame body and connected to the bed frame body, wherein the cantilever assembly is provided with a mounting point, and comprises a first pull rod and a second pull rod; and the first pull rod, the second pull rod, and the bed framework form a triangular support structure; and a linear actuator, comprising an actuator body and a driving end, wherein the driving end reciprocates axially relative to the actuator body, wherein the driving end or the actuator body is rotatably connected to the movable bed frame, and the other of the actuator body or the driving end is rotatably connected to the mounting point, wherein when the movable bed frame is driven to rotate relative to the bed framework, a reaction force of a thrust of the linear actuator is distributed to the first pull rod and the second pull rod of the cantilever assembly;

wherein the bed framework is provided with a first mounting position and a second mounting position in sequence in a length direction;

the first mounting position is provided with a fixed bed frame; and the second mounting position is provided with the movable bed frame.

2. The electric adjustable bed according to claim 1, wherein at least a portion of the cantilever assembly is located below the fixed bed frame; the first pull rod comprises a first end connected to the fixed bed frame and a second end positioned from top to bottom towards the movable bed frame; the second pull rod comprises a first end connected to the fixed bed frame and a second end connected to the second end of the first pull rod; the first pull rod, the second pull rod, and the fixed bed frame form the triangular support structure; and a connection point between the second pull rod and the first pull rod forms the mounting point.

3. The electric adjustable bed according to claim 2, wherein the first end of the first pull rod is rotatably connected to the fixed bed frame, the second end of the first pull rod is rotatably connected to the second end of the second pull rod, and the first end of the second pull rod is detachably connected to the fixed bed frame.

4. The electric adjustable bed according to claim 3, wherein after the first end of the second pull rod is detached from the fixed bed frame, the second pull rod is rotatable until the second pull rod is fitted or partially fitted onto the first pull rod.

5. The electric adjustable bed according to claim 3, wherein the fixed bed frame is connected to a hanging frame; the hanging frame is provided with a hook; the first end of the second pull rod is connected to a hanging post; and the hanging post is hung to the hook.

6. The electric adjustable bed according to claim 2, wherein the second end of the second pull rod or the second end of the first pull rod is connected to a support arm extending towards a lower side of the movable bed frame; and the mounting point is located on a rotating shaft of the support arm.

7. The electric adjustable bed according to claim 2, wherein the fixed bed frame is connected to a first support tube extending in a length direction of the fixed bed frame; the fixed bed frame is further connected to a second support tube extending in a width direction of the fixed bed frame; the second support tube is fixedly connected to an end of the first support tube adjacent to the movable bed frame; the first end of the first pull rod is rotatably connected to the first support tube, and the first end of the second pull rod is connected to the second support tube; the movable bed frame is connected to a third support tube extending in a length direction of the movable bed frame; the third support tube and the first support tube are located at a center of the bed frame body; the driving end of the linear actuator is rotatably connected to the third support tube; and the first support tube, the third support tube, the first pull rod, the second pull rod, and the actuator body are located on a same vertical plane.

8. The electric adjustable bed according to claim 1, wherein an end of the movable bed frame away from the fixed bed frame is slidably connected to a head bracket in a length direction of the movable bed frame.

9. The electric adjustable bed according to claim 8, wherein two side walls of the movable bed frame are provided with two sliding grooves, wherein the two sliding grooves extend in the length direction of the movable bed frame; two connecting ends of the head bracket are slidably fitted into the two sliding grooves, respectively; and the movable bed frame is connected to connecting screws for fixing the two connecting ends of the head bracket into the two sliding grooves.

10. The electric adjustable bed according to claim 1, wherein at least one side of the movable bed frame is connected to a side guard frame; the side guard frame comprises a mounting frame connected to the movable bed frame and a U-shaped guard frame connected to the mounting frame; the U-shaped guard frame is provided with a plurality of adjustment holes distributed in a height direction; and the plurality of adjustment holes are connected to the mounting frame through fasteners.

11. The electric adjustable bed according to claim 1, wherein the cantilever assembly is located below the movable bed frame; a first end of the first pull rod is connected to the bed framework; a first end of the second pull rod is connected to the bed framework or the fixed bed frame; a second end of the first pull rod is connected to a second end of the second pull rod; and the mounting point is formed at the second end of the second pull rod.

12. The electric adjustable bed according to claim 11, wherein a length dimension of the second pull rod is smaller than a length dimension of the first pull rod.

13. The electric adjustable bed according to claim 11, wherein compared to a connection point between the second end of the second pull rod and the second end of the first pull rod, the mounting point is located more adjacent to the bed framework.

14. The electric adjustable bed according to claim 1, wherein a distance from the mounting point to the bed framework is greater than a distance from the mounting point to a ground.

15. The electric adjustable bed according to claim 1, wherein an end of the bed framework adjacent to a headboard bracket is connected to a rail provided in a width direction of the bed framework; the rail and the end of the bed framework adjacent to the headboard bracket are connected to a connecting rod; and the connecting rod and the cantilever assembly are located on a same plane.

* * * * *